US006019045A

United States Patent [19]

Kato et al.

[11] Patent Number: 6,019,045

[45] Date of Patent: Feb. 1, 2000

[54] PROCESS FOR THE PREPARATION OF INK JET PROCESS PRINTING PLATE

[75] Inventors: Eiichi Kato; Hiroyuki Ohishi, both of Shizuoka, Japan

[73] Assignee: Fuji Photo Film Co., Ltd., Kanagawa, Japan

[21] Appl. No.: 09/066,568

[22] Filed: Apr. 27, 1998

[30] Foreign Application Priority Data

Apr. 25, 1997 [JP] Japan ..... 9-123218
May 22, 1997 [JP] Japan ..... 9-148622

[51] Int. Cl.[7] ..... B41N 1/14

[52] U.S. Cl. ..... 101/466; 101/455; 101/457; 430/49

[58] Field of Search ..... 101/455, 457, 101/460, 462, 463.1, 465, 466; 430/49, 302

[56] References Cited

U.S. PATENT DOCUMENTS

| | | | |
|---|---|---|---|
| 5,072,671 | 12/1991 | Schneider et al. | 101/467 |
| 5,503,953 | 4/1996 | Ito et al. | 430/49 |
| 5,582,106 | 12/1996 | Kanda et al. | 101/462 |
| 5,677,098 | 10/1997 | Nakayama et al. | 430/95 |
| 5,714,250 | 2/1998 | Kato et al. | 101/458 |
| 5,852,975 | 12/1998 | Miyabe et al. | 101/463.1 |

FOREIGN PATENT DOCUMENTS 17871 3/1993 Japan .

*Primary Examiner*—Stephen R. Funk
*Attorney, Agent, or Firm*—Sughrue, Mion, Zinn, Macpeak & Seas, PLLC

[57] ABSTRACT

The present invention provides a process for the preparation of a hot-melt ink jet process printing plate capable of printing many sheets of printed matters having a sharp image quality free of background stain. The present invention concerns a novel process for the preparation of an ink jet process lithographic printing plate which comprises preparing a direct imaging lithographic printing plate precursor comprising a water-resistant support having an image-receiving layer containing an inorganic pigment and a hydrophilic binder resin as main components provided thereon, and then jetting through a nozzle ink droplets obtained by heating and melting a solid ink composition at ordinary temperatures onto the image-receiving layer to form an image thereon by a hot-melt ink jet process, characterized in that the image-receiving layer comprises as the inorganic pigments a particulate silica having an average grain diameter of from 1 to 6 $\mu$m and an ultrafinely particulate colloidal inorganic pigment having an average grain diameter of from 10 to 50 nm in a weight ratio of 40:60 to 70:30 and as the hydrophilic binder resin gelatin in a weight ratio of 85:15 to 40:60 relative to that of the inorganic pigments and thus exhibits water resistance attained by the curing action of a gelatin-curing compound.

12 Claims, 3 Drawing Sheets

PROCESS FOR THE PREPARATION OF INK JET PROCESS PRINTING PLATE

FIELD OF THE INVENTION

The present invention relates to a process for the preparation of a lithographic printing plate using an ink jet recording process. More particularly, the present invention relates to a process for the preparation of a hot-melt ink jet process printing plate which gives a good plate image quality and print image quality.

BACKGROUND OF THE INVENTION

With the recent development of office machines and progress of office automation, offset lithographic printing process has spread in the art of simple printing, which comprises subjecting a direct imaging lithographic printing plate precursor comprising an image-receiving layer having a hydrophilic surface provided on a water-resistant support to various processing processes, i.e., image formation to prepare a printing plate.

A conventional direct imaging lithographic printing plate comprises an image-receiving layer containing an inorganic pigment, a water-soluble resin, a waterproofing agent, etc. provided on a support such as waterproofed paper and plastic film. In accordance with a known plate-making process, a lipophilic ink is typewritten or imagewise handwritten on such a direct imaging lithographic printing plate precursor. Alternatively, an image is hot-melt transferred from an ink ribbon to such a direct imaging lithographic printing plate precursor in a heat transfer printer. Alternatively, a lipophilic image is formed on such a direct imaging lithographic printing plate precursor in an ink jet printer using a liquid ink.

Examples of the inorganic pigment to be contained in the image-receiving layer of the printing plate precursor include kaolin, clay, talc, calcium carbonate, silica, titanium oxide, zinc oxide, barium sulfate, and alumina.

Examples of the water-soluble resin include polyvinyl alcohol (PVA), modified PVA such as carboxy PVA, starch, starch derivative, cellulose derivative such as carboxymethyl cellulose and hydroxyethyl cellulose, casein, gelatin, polyvinyl pyrrolidone, vinyl acetate-crotonic acid copolymer, styrene-maleic acid copolymer or the like.

Examples of the waterproofing agent include glyoxal, melamine formaldehyde resin, precondensate of aminoplast such as urea formaldehyde resin, modified polyamide resin such as methylolated polyamide resin, polyamide—polyamine-epichlorohydrin adduct, polyamide epichlorohydrin resin, modified polyamide polyimide resin or the like.

It is known that the image-receiving layer may further comprise crosslinking catalysts such as ammonium chloride and silane coupling agent incorporated therein.

In recent plate-making by various printers, the image-receiving layer of the printing plate precursor is required to have not only hydrophilicity to prevent printing ink stain but also water resistance as the lithographic printing plate, and further sufficient adhesion to the lipophilic image layer formed thereon. Various proposals have been made to meet these requirements.

For example, a proposal has been made to improve hydrophilicity and image adhesion by the application of an image-receiving layer formed by using zinc oxide, kaolinite and alumina as the inorganic pigment, a water-soluble resin, a waterproofing agent and acetic acid in combination to prepare a dispersion, in which acetic acid reacts with zinc oxide to produce zinc acetate, and applying the dispersion to form an image-receiving layer (JP-A-63-54288) (the term "JP-A" as used herein means an "unexamined published Japanese patent application"). Another proposal has been made to use the same image-receiving layer as proposed above except that talc or silica is used instead of alumina and an aluminum-based, zirconium-based or titanium-based metal compound is used as waterproofing agent to enhance its hydrophilicity and water resistance (JP-A-63-166590 and JP-A-63-166591).

When printing plates are prepared by an electrophotographic printer using a dry toner (PPC copying machine), a toner is attached to non-image area on the printing plates thus made. The printed matters provided by these printing plates show background stain. In order to overcome the foregoing disadvantage, JP-B-6-96353 (the term "JP-B" as used herein means an "examined Japanese patent publication") proposes the use of an inorganic pigment such as silica having an average grain diameter of from 5 to 20 $\mu$m to adjust the surface roughness of the image-receiving layer to a specific range. Further, JP-A-62-157058 proposes the combined use of silica and alumina sol each having an average grain diameter of from 5 to 20 $\mu$m as the inorganic pigment.

As an approach for eliminating ink stain on non-image area and insufficient adhesion of ink image at the plate-making process by not only PPC copying machine but also heat-sensitive transfer printer, JP-A-6-183164 proposes the combined use of a pigment such as colloidal silica and calcium bicarbonate having a grain diameter of not more than 20 nm and a lubricant such as polyethylene wax emulsion. Further, JP-B-5-17871 proposes the combined use of a synthetic silica powder having a grain diameter of not more than 20 $\mu$m, a colloidal silica having a grain diameter of not more than 50 nm and a hydrophilic polyvinyl alcohol resin.

However, the printing plates thus prepared are disadvantageous in that they have an insufficient mechanical strength of the image area and printing easily causes blanks in the image area or remarkable background stain in the non-image area.

On the other hand, the recent spread of various office automated machines, various computers and their peripheries and development of related techniques have made it possible to form an image compiled by personal computer or workstation on a lithographic printing plate directly by various printers capable of processing digital output signals.

In plate-making by an ink jet printer capable of processing digital signals, JP-A-64-27953 proposes a hot-melt ink jet process (also referred to as "solid jet process") using a liquid ink obtained by heating and melting a hydrophobic solid ink as an approach for eliminating the diffusion or absorption of an image-forming agent in a liquid ink to eliminate image stain.

However, this approach, too, is disadvantageous in that the resulting printing plates give printed matters having stain on image area and remarkable printing ink stain on background in non-image area. Further, these printing plates can print about 200 to 300 sheets at most.

SUMMARY OF THE INVENTION

It is therefore an object of the present invention to provide a process for the preparation of a hot-melt ink jet process printing plate capable of printing many sheets of printed matters having a sharp image quality free of background stain.

The foregoing object of the present invention will become more apparent from the following detailed description and examples.

The foregoing object of the present invention is accomplished by the following aspects of the present invention.

(1) A first process of the present invention is a process for producing a lithographic printing plate while forming an image by means of a hot melt type ink jet process, which comprises:

preparing a direct imaging lithographic printing plate precursor comprising a water-resistant support having provided thereon an image-receiving layer containing an inorganic pigment and a hydrophilic binder resin as main components;

heat-melting an ink composition being solid at ordinary temperatures;

and then jetting droplets of the molten ink composition onto the image-receiving layer through a nozzle to form an image thereon, wherein the image-receiving layer comprises:

as the inorganic pigments, a particulate silica having an average grain diameter of from 1 to 6 μm and an ultrafinely particulate colloidal inorganic pigment having an average grain diameter of from 10 to 50 nm in a weight ratio of 40:60 to 70:30; and as the hydrophilic binder resin, gelatin in such an amount that a weight ratio of the inorganic pigments and gelatin is from 85:15 to 40:60, the image-receiving layer being cured with a gelatin-curing compound to exhibit water resistance.

(2) A second process of the present invention is a process for producing a lithographic printing plate while forming an image by means of a hot melt type ink jet process, which comprises:

preparing a direct imaging lithographic printing plate precursor comprising a water-resistant support having provided thereon an image-receiving layer containing an inorganic pigment and a hydrophilic binder resin as main components;

heat-melting an ink composition being solid at ordinary temperatures;

jetting droplets of the molten ink composition onto an intermediate transfer unit through a nozzle to form an image thereon;

and then contact-transferring the image onto the image-receiving layer of the direct imaging lithographic printing plate precursor, wherein the image-receiving layer comprises:

as the inorganic pigments, a particulate silica having an average grain diameter of from 1 to 6 μm and an ultrafinely particulate colloidal inorganic pigment having an average grain diameter of from 10 to 50 nm in a weight ratio of 40:60 to 70:30; and as the hydrophilic binder resin, gelatin in such an amount that a weight ratio of the inorganic pigments and gelatin is from 85:15 to 40:60, the image-receiving layer being cured with a gelatin-curing compound to exhibit water resistance.

Preferred aspects of the first and second processes include the following aspects.

(3) The process of the aspect (1) or (2), wherein the surface of the image-receiving layer of the lithographic printing plate precursor exhibits a Bekk smoothness of from 30 to 500 second/10 cc.

(4) The process of any one of the aspects (1) to (3), wherein the surface of the support to be adjacent to the image-receiving layer exhibits a Bekk smoothness of not less than 300 second/10 cc.

(5) The process of any one of aspects (1) to (4), wherein the ultrafinely particulate colloidal inorganic pigment is colloidal silica, alumina sol or ultrafinely particulate titanium oxide.

(6) The process of any one of aspects (1) to (5), wherein the gelatin-curing compound is a compound containing per molecule two or more of double bond represented by formula (I):

$$CH_2{=}CH{-}X{-} \quad (I)$$

wherein X represents $-OSO_2-$, $-SO_2-$, $-CONR-$ or $-SO_2NR-$, in which R represents a hydrogen atom or an aliphatic group having 1 to 8 carbon atoms.

(7) The process of any one of aspects (1) to (6), wherein the ink composition comprises a wax having a melting point of from 50° C. to 150° C., a coloring material and an adhesion improver and, when heated to a temperature of 80° C. to 150° C., is capable of becoming a hot-melted solution having a viscosity of from 1 to 20 cps.

BRIEF DESCRIPTION OF THE DRAWINGS

By way of example and to make the description more clear, reference is made to the accompanying drawings in which.

DETAILED DESCRIPTION OF THE INVENTION

Figure 1:
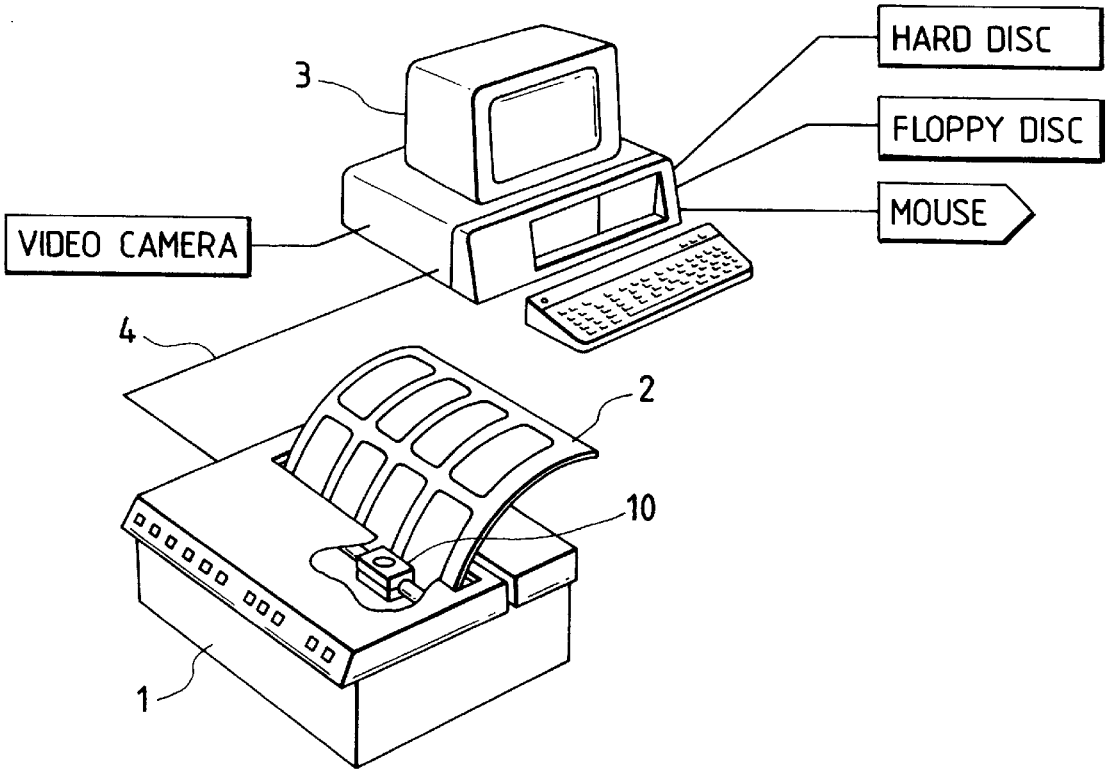
FIG. 1 is a schematic diagram illustrating an example of an apparatus system used in the present invention.

The present invention will be further described hereinafter.

The present invention involves a hot-melt ink jet process or solid jet process which comprises the formation of an image of an ink composition as a hydrophobic image-forming material which stays solid at ordinary temperatures (not higher than 35° C.) on an image-receiving layer made of a cured film containing silica, ultrafinely particulate colloidal material and gelatin (via an intermediate transfer unit in the second process). The image layer thus formed maintains a thorough affinity for the image-receiving layer with which it comes in contact and forms a rigid image portion which hardly causes defects in the image layer.

The image-receiving layer provided on the water-resistant support of the present invention contains an inorganic pigment, gelatin and a gelatin-curing compound as a waterproofing agent as main components.

The inorganic pigment comprises a particulate silica having an average grain diameter of from 1 to 6 μm and an ultrafinely particulate colloidal inorganic pigment having an average grain diameter of from 10 to 50 nm.

The particulate silica to be used herein preferably has an average grain diameter of from 1.0 to 4.5 μm. The particulate silica is a finely divided amorphous synthetic silica powder comprising silicon dioxide as a main component (not less than 99%) and having no crystalline structure.

Such a particulate silica is further described in Toshiro Kagami and Akira Hayashi, "Kojundo sirika no ouyougijutsu (Applied Technique of High Purity Silica)", Chapters 4 and 5, CMC, 1991, etc.

The finely divided synthetic silica powder of the present invention has a well-controlled porosity and pore volume and an average grain diameter of from 1 to 6 μm. However, the pore diameter, pore volume, oil absorption, surface silanol group density, etc. of the finely divided synthetic silica powder of the present invention are not specifically limited. Such a finely divided synthetic silica powder is commercially available.

As the ultrafinely particulate colloidal inorganic pigment having an average grain diameter of from 10 to 50 nm there may be used a known compound. Preferred examples of such a compound include silica sol, alumina sol, titanium oxide, magnesium oxide, and magnesium carbonate. More preferred examples include silica sol, alumina sol, and ultrafinely divided titanium oxide.

Silica sol is a dispersion in which ultrafinely divided silica having a grain diameter of from 1 to 100 nm and having many hydroxyl groups on the surface thereof and forming siloxane bond (—Si—O—Si—) in the inside is dispersed in water or a polar solvent. Such a silica sol is also referred to as "colloidal silica", and is described in the above cited "Kojundo sirika no ouyougijutsu (Applied Technique of High Purity Silica)" in details. Alumina sol is an alumina hydrate (boehmite-based compound) having a colloidal size of from 5 to 200 nm dispersed in water, in which an anion (e.g., halogen ion such as fluorine ion and chlorine ion, carboxylic anion such as acetic ion) functions as a stabilizer.

Among these finely divided colloidal materials, those having an average grain diameter of from 10 to 50 nm, preferably from 10 to 40 nm can be used in the present invention. All these ultrafinely particulate colloidal inorganic pigments are commercially available.

Only when the grain diameter of the particulate silica and ultrafinely particulate colloidal inorganic pigment to be used as inorganic pigment of the present invention falls within the above defined range, the resulting image-receiving layer can maintain a sufficient strength and the printing plate, obtained by subjecting an ink composition as a hydrophobic image-forming material being solid at ordinary temperatures (not higher than 35° C.) to solid jet image forming process, has a fine image area such as fine line, fine letter and dot which has a sharp image free of blank, warp and stain.

The weight ratio of the particulate silica and the ultrafinely particulate colloidal inorganic pigment is from 40:60 to 70:30, preferably from 50:50 to 60:40.

The gelatin to be used as a hydrophilic binder resin herein is one of derived proteins and thus is not specifically limited so far as it is produced from collagen. The gelatin is preferably light-colored, transparent, tasteless and odorless. Further, gelatin for photographic emulsion is more desirable because it exhibits physical properties (such as viscosity of the resulting aqueous solution and jelly strength of gel) falling within predetermined ranges.

The image-receiving layer of the present invention comprises as the foregoing hydrophilic binder resin gelatin such that the weight ratio of the inorganic pigment to gelatin is from 85:15 to 40:60, preferably from 85:15 to 60:40 relative to that of the inorganic pigments.

Within this range, enhancement of film strength, prevention of attachment of printing ink to non-image area and enhancement of adhesion to image area (impression capacity) as mentioned above can be improved.

The image-receiving layer of the present invention comprises a gelatin-curing compound incorporated therein to cure itself and hence exhibit a good water resistance.

As such a gelatin-curing compound there can be used a known compound as disclosed in T. H. James, "The Theory of the Photographic Process", Section III, Chapter 2, Macmillan Publishing Co., Inc., 1977, and Research Disclosure No. 17643, page 26, December, 1970. Preferred examples of such a gelatin-curing compound include dialdehydes such as succinaldehyde, glutaraldehyde and adipaldehyde, diketones such as 2, 3-butanedione, 2, 5-hexanedione, 3-hexene-2, 5-dione and 1, 2-cyclopentanedione, and active olefine compounds having two or more double bonds and electron attractive groups bonded adjacent to the double bonds per molecule.

More preferably, the gelatin-curing compound is a compound having per molecule two or more of double bond group represented by the following general formula (I):

$$CH_2{=}CH{-}X{-} \quad (I)$$

wherein X represents $-OSO_2-$, $-SO_2-$, —CONR— or $-SO_2NR-$ (in which R represents a hydrogen atom or $C_{1-8}$ aliphatic group).

R preferably represents a hydrogen atom or a $C_{1-6}$ alkyl group such as methyl, ethyl, propyl, butyl, methylol, 2-chloroethyl, 2-hydroxyethyl, 2-hydroxypropyl, 2-carboxylethyl and 3-methoxypropyl. More preferably, X in the general formula (I) represents $-SO_2-$.

Specific examples of the compound having per molecule two or more of double bond group represented by the following general formula (I) include resorcinolbis (vinylsulfonate), 4, 6-bis(vinylsulfonyl)-m-xylene, bis (vinylsulfonylalkyl)ether, bis(vinylsulfonylalkyl)amine, 1, 3, 5-tris(vinylsulfonyl) hexahydro-s-triazine, diacrylamide, 1, 3-bis(acryloyl)urea, and N-N'-bismaleimide.

The gelatin-curing compound is generally used in an amount of from 0.5 to 20 parts by weight, preferably from 0.8 to 10 parts by weight based on 100 parts by weight of gelatin.

The image-receiving layer of the present invention thus formed maintains a sufficient film strength and exhibits a sufficient adhesion to the surface of the water-resistant support described later to protect itself against damage during printing. Further, the printing plate obtained by subjecting an ink composition as a hydrophobic image-forming material which stays solid at ordinary temperatures (not higher than 35° C.) to solid jet image forming process has a fine image area such as fine line, fine letter and dot which has a sharp image free of blank, warp and stain.

When the printing plate is used in printing, it exhibits so extremely an excellent hyrophilicity as to prevent the non-image portion from being stained with the printing ink and so good an adhesion to the image portion as to cause no image blanks even after more than 1,000 sheets of printing.

The image-receiving layer of the present invention may comprise various additives such as an interface adjuster (surface adjustor), an anti-foaming agent and a buffer for adjusting film pH incorporated therein to improve the applicability of the dispersion for forming an image-receiving layer.

The thickness of the image-receiving layer of the present invention is preferably from about 3 to 30 g as calculated in terms of the coated amount (dry basis) of the image-receiving composition per $m^2$.

The smoothness of the image-receiving layer of the present invention is preferably from 30 to 500 sec/10 cc, more preferably from 45 to 300 sec/10 cc as represented by Bekk smoothness.

When the surface smoothness of the image-receiving layer falls within the above defined range, a sharp image free of blanks can be formed, and the adhesion between the image portion and the image-receiving layer can be enhanced by the increase of the contact area. The resulting impression capacity is not less than 500 sheets by the first process or not less than 1,000 sheets by the second process.

Bekk smoothness can be determined by means of a Bekk smoothness tester according to JIS P 8119. The Bekk smoothness tester is designed to measure the time required until a predetermined amount (10 cc) of air passes through the gap between the surface of a highly smooth-finished circular glass plate having a hole made in the central part thereof and the specimen under reduced pressure and a predetermined load (1 $kg/cm^2$).

The image-receiving layer of the present invention is provided on a water-resistant support. As such a water-resistant support there can be used a waterproofed paper, a plastic film, or a metal foil-laminated paper or plastic film.

The surface of the support adjacent to the image-receiving layer, i.e, the surface to be provided with the image-receiving layer, is adjusted to have a Bekk smoothness of not less than 300 sec/10 cc, preferably from 900 to 3,000 sec/10 cc, more preferably from 1,000 to 3,000 sec/10 cc.

The restriction of the smoothness of the support on the surface thereof adjacent to the image-receiving layer to a Bekk smoothness of not less than 300 sec/10 cc makes it possible to further improve the image reproducibility and impression capacity. The enhancement effect can be exerted even if the smoothness of the image-receiving layer remains the same. The increase in the smoothness of the support probably makes it possible to enhance the adhesion between the image portion and the image-receiving layer.

The highly smooth surface of the water-resistant support thus controlled is the surface of the support to which the image-receiving layer is directly applied. For example, if an undercoating layer or overcoating layer as described later is provided on the support, the highly smooth surface is the surface of the undercoating layer or overcoating layer.

This makes it possible. to sufficiently maintain the image-receiving layer having the thus controlled surface conditions without having any effects of unevenness of the surface of the support and further improve the image quality.

The restriction of the smoothness to the above defined range can be accomplished by various known methods. Specific examples of these methods for adjusting the Bekk smoothness of the surface of the support includes a method involving the melt adhesion of a resin to the surface of a substrate, and a method involving the calendering by a highly smooth heat roller.

The melt adhesion of a resin is preferably carried out by an extrusion laminating method. The coating by extrusion laminating method makes it possible to prepare a support the smoothness of which has been adjusted to a desired value. The extrusion laminating method comprises melting a resin, forming the resin thus melted into a film, immediately contact-bonding the film onto a base paper, and then cooling the laminate. Various apparatus have been known for this method.

The thickness of the resin layer thus laminated is not less than 10 $\mu$m, preferably from 10 to 30 $\mu$m from the standpoint of stability in production.

Examples of the foregoing resin include polyethylene resin, polypropylene resin, acrylic resin, methacrylic resin, epoxy resin, and copolymer thereof. Two or more of these resins can be used in combination. Preferred among these resins is polyethylene resin. Particularly preferred among these polyethylene resins is a mixture of a low density polyethylene and a high density polyethylene. The mixture composition can provide uniform coating, and the resulting coating layer exhibits an excellent heat resistance. Further, the use of the foregoing mixture composition makes it possible to give a higher electrical conductivity when an electrically conductive material as described later is incorporated in the resin layer.

The foregoing low density polyethylene preferably exhibits a density of from 0.915 to 0.930 g/cc and a melt index of from 1.0 to 30 g/10 min. The foregoing high density polyethylene preferably exhibits a density of from 0.940 to 0.970 g/cc and a melt index of from 1.0 to 30 g/10 min. The mixing proportion of the low density polyethylene to the high density polyethylene is preferably from 10:90 to 90:10 by percent by weight.

If a base paper is used as a substrate, it is preferred that the surface of the base paper be subjected to coating with a polyethylene derivative such as ethylene-vinyl acetate copolymer, ethylene-acrylic acid ester copolymer, ethylene-methacrylic acid ester copolymer, ethylene-acrylic acid copolymer, ethylene-methacrylic acid copolymer, ethylene-acrylonitrile-acrylic acid copolymer and ethylene-acrylonitrile-methacrylic acid copolymer or corona discharge treatment to enhance the adhesion between the base paper and the foregoing resin layer. Alternatively, the base paper may be subjected to surface treatment as disclosed in JP-A-49-24126, JP-A-52-36176, JP-A-52-121683, JP-A-53-2612, JP-A-54-111331, and JP-B-51-25337.

The calendering as an alternate method can be accomplished by calendering a substrate such as paper described later or a support obtained by forming an undercoating layer on such a substrate. The calendering conditions can be properly controlled by the composition of the substrate or undercoating layer. The conditions such as kind and combination of rolls such as metallic roll, resin roll and cotton roll, the number of stages of calender roll, roll-nip pressure and roll surface temperature can be properly selected.

In the present invention, an undercoating layer may be provided interposed between the support and the image-receiving layer for the purpose of enhancing the water resistance and the interlaminar adhesion. A back coating layer (back layer) may be provided on the surface of the support opposite the image-receiving layer for the purpose of preventing curling. The smoothness of the back coating layer is preferably from 150 to 700 sec/10 cc.

This arrangement makes it possible to accurately set the printing plate in an offset press without causing shift or slippage when supplied into the offset press.

The adjustment of the smoothness of the undercoating layer and the back coating layer to the respective ranges can be accomplished by effecting a plurality of calendering steps, e.g., calendering after the formation of an undercoating layer, forming a back coating layer, and then calendering again, or by combining the adjustment of proportion and grain size of pigment in the undercoating layer and back coating layer and the adjustment of the calendering conditions.

As the substrate to be incorporated in the printing plate precursor of the present invention there can be used a substrate such as wood pulp paper, synthetic pulp paper, mixed paper made of wood pulp and synthetic pulp, non-wooven cloth, plastic film, cloth, metallic sheet and composite sheet thereof as it is. In order to obtain the smoothness defined herein and adjust the water resistance and other properties, the foregoing substrate can be impregnated with a coating compound made of a hydrophobic resin to be used in the undercoating layer or back coating layer as described later, a water-dispersible or water-soluble resin, a pigment, etc.

In the present invention, a support comprising an undercoating layer and a back coating layer provided on the foregoing substrate is preferably used to meet the requirements for lithographic printing plate precursor such as printability, e.g., recording properties, water resistance and durability and adjust the smoothness to the above defined range. The undercoating layer and back coating layer can be formed by applying a coating solution containing a resin and a pigment to a support and then drying the coated material or laminating the resin layer on the support. Specific examples of such a resin include hydrophobic resins such as acrylic resin, vinyl chloride resin, styrene resin, styrene-butadiene resin, styrene-acryl resin, urethane resin, vinylidene chloride resin and vinyl acetate resin, and hydrophilic resins such as polyvinyl alcohol resin, cellulose derivative, starch, starch derivative, polyacrylamide resin and styrene-maleic anhydride copolymer.

Examples of the pigment include clay, kaolin, talc, diatomaceous earth, calcium carbonate, aluminum hydroxide, magnesium hydroxide, titanium oxide and mica. It is preferred that the grain size of the pigment be properly selected to attain the desired smoothness. For example, the undercoating layer needs to have a relatively high smoothness. Thus, a pigment having a grain size of not more than 8 $\mu$m, preferably from 0.5 to 5 $\mu$m, obtained by excluding those having a small grain diameter and a great grain diameter can be preferably used. Further, the back coating layer needs to have a relatively low smoothness as compared with the undercoating layer. Thus, a pigment having a great grain diameter, i.e., from about 0.5 to 10 $\mu$m can be preferably used. The foregoing pigment is preferably incorporated in the undercoating layer in an amount of from 80 to 150 parts by weight and in the back coating layer in an amount of from 80 to 200 parts by weight based on 100 parts by weight of the resin used. The undercoating layer and back coating layer can comprise a waterproofing agent such as melamine resin and polyamide epichlorohydrin resin incorporated therein to obtain an excellent water resistance to advantage. The grain diameter of the pigment can be determined by observing photograph taken by scanning electron microscope (SEM). If the grain is spherical, the grain diameter is determined as calculated in terms of circle having the same area as the projected area.

The preparation of the lithographic printing plate precursor of the present invention can be normally accomplished by optionally applying a solution containing an undercoating layer component to one side of a support, drying the coated material to form an undercoating layer thereon, optionally applying a solution containing a back coating layer component to the other side of the support, drying the coated material to form a back coating layer thereon, applying a coating solution containing an image-receiving layer component to the support, and then drying the coated material to form an image-receiving layer thereon. The coated amount of the image-receiving layer, the undercoating layer and the back coating layer each are preferably from 1 to 30 g/m$^2$, particularly from 6 to 20 g/m$^2$.

More preferably, the thickness of the water-resistant support having an undercoating layer and/or a back coating layer provided thereon is from 90 to 130 $\mu$m, particularly from 100 to 120 $\mu$m.

The solid ink to be used in the hot-melt ink jet process (or solid jet process) as an ink composition which stays solid at ordinary temperatures will be further described hereinafter.

As previously mentioned, the solid ink to be used herein stays solid at a temperature of not higher than 35° C. and, when heated to a temperature of from 80° C. to 150° C., becomes a hot-melted solution which exhibits a melt viscosity of from 1 to 20 cps, preferably from 2 to 15 cps. As such a solid ink there can be used a known solid ink.

In some detail, the hot-melt ink of the present invention comprises at least a wax which stays solid at ordinary temperatures and exhibits a melting point of from 50° C. to 150° C., a resin, a coloring material and an adhesion improver. It preferably comprises a wax having a melting point of from 50° C. to 150° C. in an amount of from 30 to 90% by weight, a resin in an amount of from 5 to 70% by weight, a dye or pigment as a coloring material in an amount of from 0.1 to 10% by weight and an adhesion improver in an amount of from 2 to 40% by weight as ink components.

As the wax having a melting point of from 50° C. to 150° C., i.e., so-called normally solid wax, to be used as one component of the vehicle, one being thermally stable, when it is in molten state given by heating to a temperature of not less than melting point, at least, at the ink jetting temperature of the ink jet printer, can be used.

Such a wax can be selected from known waxes without any restriction. Examples of the wax employable herein include petroleum wax, preferably paraffin wax or microcrystalline wax, vegetable wax, preferably candelilla wax, carnauba wax, rice wax or solid wax, animal wax, preferably beeswax, lanolin or whale wax, mineral wax, preferably montan wax, synthetic hydrocarbon, preferably Fischer-Tropsch wax or polyethylene wax, hydrogenated wax, preferably hardened castor oil or hardened castor oil derivative, modified wax, preferably montan wax derivative, paraffin wax derivative, microcrystalline wax derivative or polyethylene wax derivative, higher aliphatic acid, preferably behenic acid, stearic acid, palmitic acid, myristic acid or lauric acid, higher alcohol, preferably stearyl alcohol or behenyl alcohol, hydroxystearic acid, preferably 12-hydroxystearic acid or 12-hydroxystearic acid derivative, ketone, preferably stearon or lauron, aliphatic amide, preferably lauric acid amide, stearic acid amide, oleic acid amide, erucic acid amide, ricinoleic acid amide, 12-hydroxystearic acid amide, special aliphatic acid amide or N-substituted aliphatic acid amide, amine, preferably dodecylamine, tetradecylamine or octadecylamine, ester, preferably methyl stearate, octadecyl stearate, glycerin aliphatic acid ester, sorbitan aliphatic acid ester, propylene glycol aliphatic acid ester, ethylene glycol aliphatic acid ester or polyoxyethylene aliphatic acid ester, and polymer wax, preferably $\alpha$-olefin-maleic anhydride copolymer wax. These waxes can be used singly or in admixture. The wax is preferably incorporated in the ink composition in an amount of from 30 to 90% by weight based on the total weight of the ink.

The resin to be used as one component of the vehicle with the wax acts to render the ink transparent while providing the ink with adhesion to the printing paper, controlling the viscosity of the ink and inhibiting the crystallizability of the wax.

As the foregoing resin there is preferably used an oil-soluble resin. Examples of the oil-soluble resin employable herein include olefinic resin, preferably polyethylene resin, polypropylene resin or polyisobutylene resin, vinyl resin, preferably ethylene-vinyl acetate copolymer resin, vinyl chloride-vinyl acetate copolymer resin, vinyl acetate resin or ethylene-vinyl chloride-vinyl acetate resin, acrylic resin, preferably methacrylic acid ester resin, polyacrylic acid ester resin, ethylene-ethyl acrylate copolymer resin or ethylene-methacrylic acid copolymer resin, phenolic resin, polyurethane resin, polyamide resin, polyester resin, ketone resin, alkyd resin, rosin, hydrogenated rosin, petroleum resin, hydrogenated petroleum resin, maleic resin, butyral resin, terpene resin, hydrogenated terpene resin, and chroman-indene resin. These resins (high molecular compounds) can be used singly or in admixture in an amount of from 5 to 70% by weight based on the total weight of the ink composition.

As the coloring material there can be used any dye or pigment which has heretofore been incorporated in an oil-based ink composition.

As the pigment there can be used any pigment which is normally used in the art of printing regardless of whether it is inorganic or organic. In some detail, any known pigments can be used without any restriction. Examples of the pigment employable herein include carbon black, cadmium red, molybdenum red, chrome yellow, cadmium yellow, titanium yellow, chromium oxide, pyridian, titanium cobalt green, ultramarine blue, Prussian blue, cobalt blue, azo pigment, phthalocyanine pigment, quinacridone pigment, isoindolinone pigment, dioxazine pigment, threne pigment, perylene pigment, perinone pigment, thioindigo pigment, quinophthalone pigment, and metal complex pigment.

Preferred examples of the dye employable herein include oil-soluble dyes such as azo dye, metal complex dye, naphthol dye, anthraquinone dye, indigo dye, carbonium dye, quinoneimine dye, xanthene dye, cyanine dye, quinoline dye, nitro dye, nitroso dye, benzoquinone dye, naphthoquinone dye, phthalocyanine dye and metal phthalocyanine dye.

These pigments or dyes can be used singly or in proper combination. It is preferably used in an amount of from 0.1 to 10% by weight based on the total weight of the ink composition.

The adhesion improver to be used herein acts to effectively render the solid hot-melt ink plastic or adhesive without drastically changing the viscosity, melting point and fusion energy of the ink as a whole to drastically enhance the fixability of the ink to the recording sheet and the fixability of recorded dots. As the adhesion improver there can be used a polyolefin or derivative thereof (e.g., polyolefinic polyol). It is preferably incorporated in the ink composition in an amount of from 2 to 40% by weight based on the total weight of the ink.

The ink of the present invention can further comprise various additives such as dispersant and rust preventive incorporated therein. The ink of the present invention can be obtained by mixing the foregoing materials under heating. The melting point of the ink can be adjusted to various values by changing the kind of the constituents used and the mixing proportion thereof if they were used in admixture. The melting point of the ink can be determined by means of an ordinary melting point meter or thermal analyzer such as DSC and DTA.

The method for forming an image on the foregoing lithographic printing plate precursor (hereinafter also referred to as "master") will be further described hereinafter. An example of the apparatus system for implementing the method is shown in FIG. 1.

The apparatus system shown in FIG. 1 has an ink jet recording apparatus 1 of solid jet process using a solid ink.

The first process will be further described in connection with FIGS. 1 and 2*a*.

As shown in FIG. 1, pattern data of image (figure and sentence) to be formed on a master 2 is supplied into a solid jet process ink jet recording apparatus 1 from a data source such as computer 3 through a transmitting means such as path 4. A solid ink is melted in an ink jet recording head 10 of the recording apparatus 1, and then stored in an ink tank. When the master 2 passes through the recording apparatus 1, microdroplets of ink are sprayed onto the master 2 in response to the data supplied. In this manner, the ink is patternwise attached to the master 2 according to the data.

The image-forming agent thus attached coagulates itself. Thus, the formation of an image on the master 2 is finished to obtain a plate master (printing plate precursor).

Examples of the structure of ink jet recording apparatus for use in the apparatus system of FIG. 1 are shown in FIGS. 2*a* to 4*b*. In these figures, like index numbers refer to similar members.

Figure 2A:
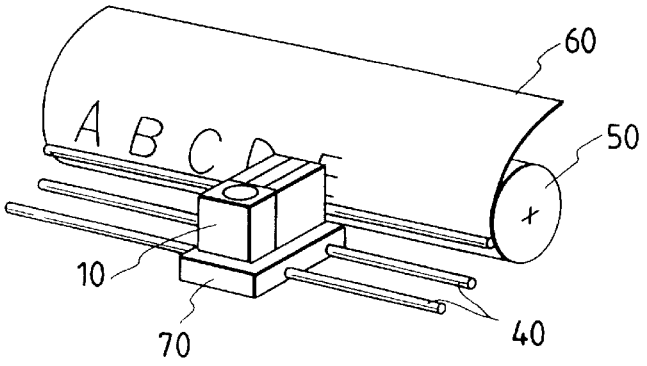
FIG. 2*a* is a schematic diagram illustrating an essential part of an ink jet recording apparatus used in the first process of the present invention.

FIG. 2*a* is a schematic diagram illustrating the structure of an essential part of the ink jet recording apparatus. The ink jet recording apparatus of FIG. 2*a* comprises a head portion 10 which heats and melts a solid ink and jets the liquified ink through a nozzle, a carriage 70 for supporting the head 10, and a guide 40 for the sliding of the carriage 70 and a platen 50. A master 60 (i.e., master 2 in FIG. 1) is supplied into the ink jet recording apparatus.

In this arrangement, the liquified ink is jetted through the nozzle onto the master 2 while the head portion 10 supported by the carriage 70 slides horizontally along the guide 40, in response to printing signal from the higher apparatus. Thus, printing is effected.

The second process will be further described in connection with FIGS. 1 and 2*a*.

As shown in FIG. 1, pattern data of image (figure and sentence) to be formed on a master 2 is supplied into a solid jet process ink jet recording apparatus 1 from a data source such as computer 3 through a transmitting means such as path 4. A solid ink is melted in an ink jet recording head 10 of the recording apparatus 1, and then stored in an ink tank. Microdroplets of ink are sprayed onto an intermediate transfer unit 28 as described later in accordance with the data supplied. In this manner, the ink is patternwise attached to the surface of the intermediate transfer unit 28 in accordance with the data. The thickness of attachment, i.e., thickness of the ink layer, is normally from 1 to 50 $\mu$m, preferably from 3 to 35 $\mu$m.

Figure 2B:
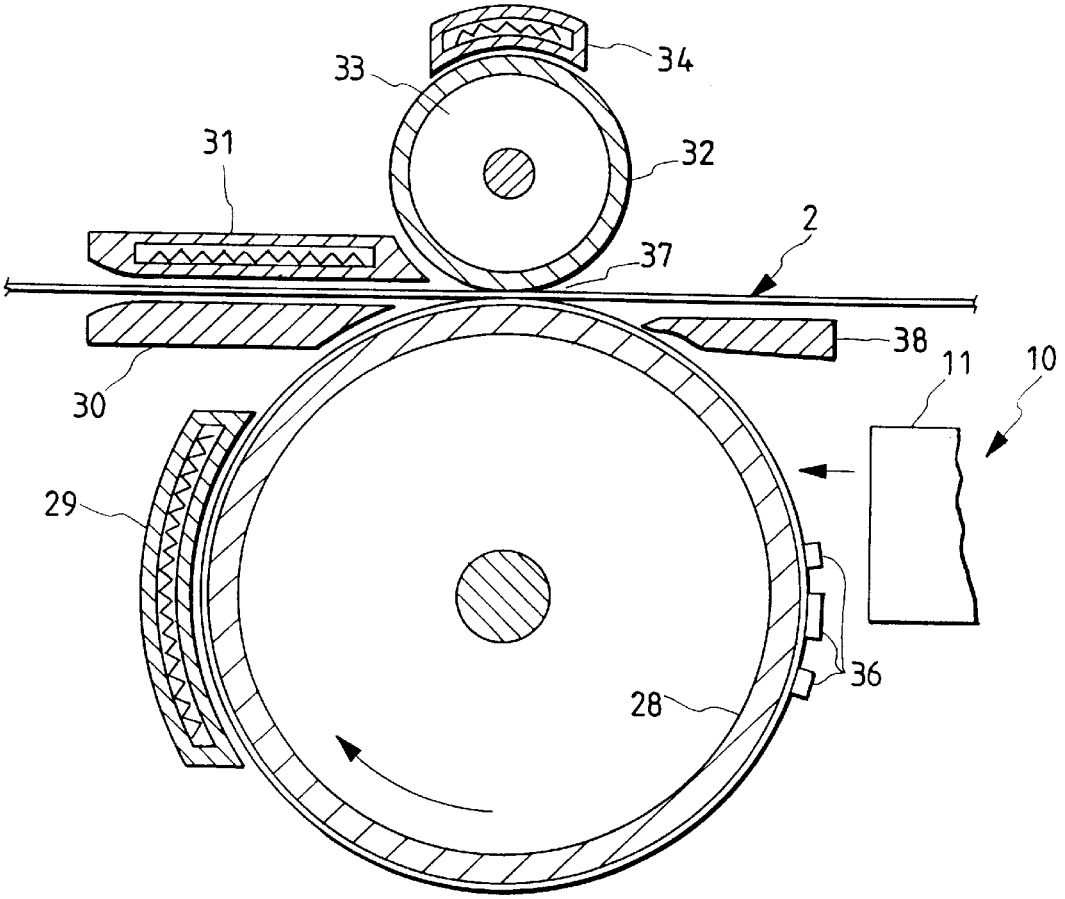
FIG. 2*b* is a schematic diagram illustrating an essential part of an ink jet recording apparatus used in the second process of the present invention.

FIG. 2*b* is a schematic diagram illustrating the structure of an essential part of the foregoing ink jet recording apparatus. The ink jet recording apparatus of FIG. 2*b* is designed to transfer the ink image from the surface of the intermediate transfer unit to the master through a rapid process. A print head 11 is supported fixedly or movably by a proper housing and a supporting element (not shown) and attaches the molten ink to the intermediate transfer unit 28. The intermediate transfer unit 28 may be a web or platen other than drum. It can be made of a proper material. The intermediate transfer unit is not specifically limited. In practice, however, it can be formed of a metal such as aluminum, nickel and iron phosphate, an elastomer such as fluoro elastomer, perfluoro elastomer, silicone rubber and polybutadiene, a plastic such as polytetrafluoroethylene having polyphenylene sulfate incorporated therein, a thermoplastic resin such as polyethylene, nylon and FEP (fluoroethylene propylene resin), a thermosetting resin such as acetal, ceramics or the like. Any of these materials can be used so far as the resulting intermediate transfer unit 28 has an exposed surface having a sufficient hardness, allows the master 2 to smoothly passes through the gap between the intermediate transfer unit 28 and the transfer roller 32 and can support the image-forming ink without any troubles. A preferable material of the intermediate transfer unit 28 is anodized aluminum. The intermediate transfer unit 28 has a surface smoothness of not less than 300 sec/10 cc, preferably not less than 800 sec/10 cc, more preferably from not less than 1,000 sec/10 cc to not more than 3,000 sec/10 cc as represented by Bekk smoothness.

A master guide 30 shown in FIG. 2*b* guides the master 2 from a paper feeder (not shown) into an intermediate transfer zone 37 between a roller 32 and the intermediate transfer 28. A plurality of strip fingers 38 (only one shown) are provided in the printer apparatus 10. It is designed to peel the master 2 off the surface of the intermediate transfer unit 28. The roller 32 comprises a core portion 33 made of a metal (preferably steel) surrounded by an elastomer having a Shore D hardness of from about 40 to 45. Preferred examples of the elastomer material include silicone, urethane, nitrile, EPDM, and other elastic materials. The elastomer covering the roller 32 presses the master 2 so that an ink image 36 is melted, extended, and fixed.

The ink to be used in this process, i.e., system of the present invention normally stays solid but becomes liquid when heated to a temperature of from about 85° C. to 150° C. When heated to a temperature of higher than this range, the ink undergoes deterioration or chemical decomposition. The ink thus melted is then jetted through an ink jet orifice of the print head 11 onto the surface of the intermediate transfer unit 28 in a raster scanning process. The ink then cools and solidifies into soft state. The ink is then contact-transferred onto the master 2 between the intermediate transfer unit 28 and the roller 32 at the intermediate transfer zone 37. The temperature at which the ink is kept in soft state is from about 30° C. to 80° C.

When the ink image in soft state is interposed between the roller 32 and the intermediate transfer unit 28, it is deformed into a final image 36 which is then fixed on the master 2 under pressure by the roller 32 or under heating by a heater 29 or 31. This treatment may be facilitated by a heater 34 which is optionally provided. The pressure applied to the ink image 36 is from about 1 to 150 $Kgf/cm^2$, more preferably from about 30 to 100 $Kgf/cm^2$, most preferably from about 50 to 60 $Kgf/cm^2$. The pressure used needs to be high enough to fix the ink image 36 on the master 2.

The ink image which has once been fixed on the master 2 cools to an ambient temperature of from about 20° C. to 25° C. The ink constituting the ink image needs to be ductile and must be deformable without cracking even when kept at temperatures of higher than the glass transition temperature thereof. The ink hardens at temperatures of not higher than the glass transition temperature. The temperature at which the ink image thus transferred is kept ductile and soft is from about −10° C. to 120° C., preferably from 10° C. to 90° C. Since the master 2 is normally porous as mentioned above, the ink permeates the image-receiving layer.

In FIG. 2*b*, the heater 29 may be a heat emission type resistance heater disposed as shown. In the best embodiment, it is disposed inside the intermediate transfer unit 28. Heaters 31 and 34 may be disposed inside the master guide 30 and the melting and fixing roller 32, respectively. The heater 29 is designed to heat the intermediate transfer unit 28 to a temperature of from about 25° C. to about 100° C., preferably from about 40° C. to 80° C.

The heater 31 preferably heats the master 2 to a temperature of from about 70° C. to 130° C. prior to heating of the ink image 36. The use of the heater 34 makes it possible to heat the roller 32 to a temperature of from about 25° C. to 200° C. The heater 34 may be disposed inside the roller 32.

As previously mentioned, the ink is jetted through the ink jet head 11 onto the surface of the intermediate transfer unit 28.

The first and second processes will be further described in connection with FIGS. 3 to 4*b*.

Figure 3:
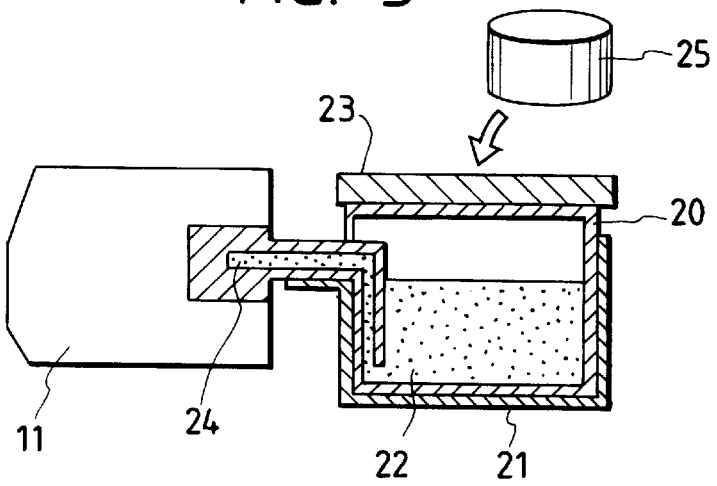
FIG. 3 is a schematic diagram illustrating a head portion of the ink jet recording apparatus used in the present invention.

FIG. 3 is a schematic diagram illustrating the structure of the head portion 10 of the foregoing ink jet recording apparatus. As shown in FIG. 3, the head portion 10 roughly comprises an ink jet head 11 and an ink tank 20. The head portion 10 has a means 21 for heating and melting a solid ink 25. Such a means can be made of a heat-generating resistor. FIG. 3 will be described with reference to the use of heat-generating resistor. Housed in the ink tank 20 of the head portion 10 is an ink 22 which has been melted by the heat-generating resistor 21. A tank cap 23 is mounted on the ink tank 20. Further, the head portion 10 comprises an ink feed passage 24 through which the molten ink 22 is supplied from the ink tank 20 into the ink jet head 11.

When the solid ink 25 is supplied into the ink tank 20 by the operator or otherwise, it is heated and melted by the heat-generating resistor 21 provided surrounding the ink tank 20, and then supplied into the ink jet head 11 through the ink feed passage 24.

Figure 4A:
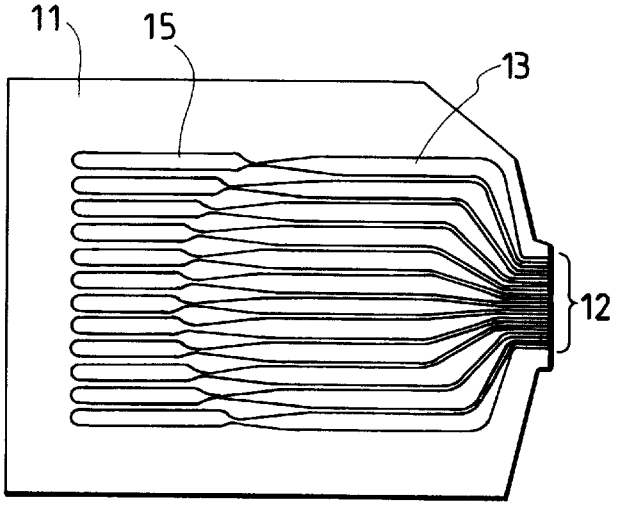
FIGS. 4*a* and 4*b* are schematic diagrams illustrating an ink jet head of the head portion of the ink jet recording apparatus used in the present invention, wherein the reference numeral 1 indicates an ink jet recording apparatus, the reference numeral 2 indicates a master, the reference numeral 3 indicates a computer, the reference numeral 4 indicates a path, the reference numeral 10 indicates a head portion, the reference numeral 11 indicates an ink jet head, the reference numeral 12 indicates a nozzle, the reference numeral 13 indicates a pressure chamber, the reference numeral 14 indicates a piezoelectric element, the reference numeral 15 indicates a common ink inlet, the reference numeral 15*a* indicates an ink supply chamber, the reference numeral 20 indicates an ink tank, the reference numerals 21 and 21*a* each indicate a heat-generating resistor, the reference numeral 21*b* indicates an electrode, the reference numeral 22 indicates a molten ink, the reference numeral 23 indicates a tank cap, the reference numeral 24 indicates an ink feed passage, the reference numeral 25 indicates a solid ink, the reference numeral 28 indicates an intermediate transfer unit, the reference numeral 29 indicates a heater, the reference numeral 30 indicates a master guide, the reference numeral 31 indicates a heater, the reference numeral 32 indicates a roller, the reference numeral 33 indicates a core portion, the reference numeral 34 indicates a heater, and the reference numeral 36 indicates an ink image.
Figure 4B:
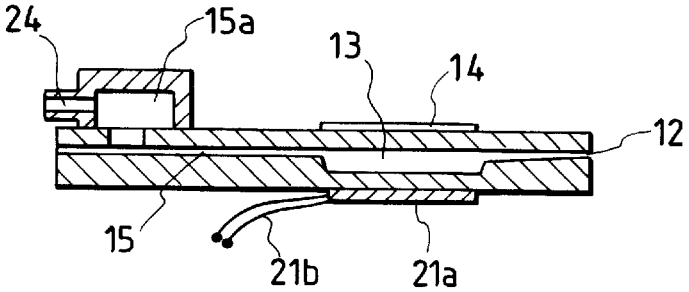

FIG. 4*a* and 4*b* are schematic diagrams illustrating the foregoing ink jet head 11. As shown in FIGS. 4*a* and 4*b*, the foregoing ink jet head 11 comprises a nozzle 12, a pressure chamber 13, a piezoelectric element 14 for pressurizing the ink in the pressure chamber 13, a common ink chamber 15, an ink feed inlet 15*a*, a heat-generating resistor 21*a* for heating the molten ink 22, and an electrode 21*b*. The molten ink 22 which has been supplied into the pressure chamber 13 by the common ink chamber 15 is jetted through the nozzle 12 driven by the piezoelectric element 14 while being kept to a temperature suitable for ink jetting by the heat-generating resistor 21*a* in the pressure chamber 13. In the first process, the molten ink which has been thus jetted is attached to the master 2. The ink then permeates the master 2 where it then solidifies to complete fixing. In the second process, the molten ink which has been thus jetted is attached to the intermediate transfer unit 28 from which it is then transferred to the master 2. The ink then permeates the master 2 where it then solidifies to complete fixing.

The foregoing ink jet head 11 has been described with reference to the use of an electromechanical element such as piezoelectric element. However, other pressurizing means such as wire type pressurizing mechanism may be used to exert similar effects. As the heating means, there may be used a heating means such as ceramic heater instead of heat-generating resistor. The temperature of the molten ink 22 in the ink tank 20 may not be so high as that of the ink which is about to be jetted from the pressure chamber 13. Therefore, the heat-generating resistor 21 provided outside the ink tank 20 and the heat-generating resistor 21*a* provided outside the pressure chamber 13 may be separately energized so that the increase in the temperature of the ink jet recording apparatus can be suppressed.

On the other hand, if the ink tank 20 and the ink jet head 11 are heated to the same temperature, the ink tank 20 and the ink jet head 11 may be separately heated by the foregoing heat-generating resistors 21 and 21*a*, respectively. Alternatively, the ink tank 20 and the ink jet head 11 may be together covered by a house provided with a heating mechanism having a nichrome wire or the like incorporated therein.

The heating temperature of the head of the ink jet recording apparatus is generally adjusted to a range of from 80° C. to 150° C., preferably from 90° C. to 130° C.

As the recording head there is preferably used one which makes the use of technique using solid ink and gives a high resolution.

For example, when a solid ink is supplied into the ink tank 20 of the ink jet recording apparatus of FIG. 3 where it is melted at a head heating temperature of 120° C., and then jetted at a piezoelectric element drive voltage of 70 V and a viscosity of 20 cps, ink droplets having a grain size of 60 $\mu$m can be jetted through a nozzle having a diameter of 40 $\mu$m to form a sharp image at a resolution of 600 dpi.

The ink image 36 on the surface of the intermediate transfer unit 28 cools to an intermediate state of ductile solid matter as the intermediate transfer unit 28 rotates. It then enters into the intermediate transfer zone 37 between the roller 32 and the intermediate transfer unit 28. Under pressure, the ink image 36 is deformed into a final image which is then transferred to the surface of the master 2. In this manner, the ink image 36 is transferred to the master 2 under pressure by the elastic surface of the roller 32.

The plate master obtained by forming an image on a lithographic printing plate precursor through a solid jet process acts as an offset lithographic printing plate.

The present invention will be further described in the following examples, but the present invention should not be construed as being limited thereto.

EXAMPLE 1 AND COMPARATIVE EXAMPLES A TO D (Preparation of lithographic printing plate precursor)

The following compositions were subjected to dispersion with glass beads in a paint shaker (produced by Toyo Seiki Seisakusho, Ltd.) for 60 minutes. The glass beads were then removed by filtration to obtain a dispersion.

| | |
|---|---|
| 10% Aqueous solution of gelatin | 94 g |
| Silica: Silysha 430 (produced by Fuji-Silysha Chemical Ltd.; average grain diameter: 2.5 $\mu$m) | 21.9 g |
| 20% Aqueous solution of colloidal silica: Snowtex C (produced by Nissan Chemical Industries, Ltd.; average grain diameter: 10–20 nm) | 90 g |
| Fluorinated alkylester FC430 (produced by 3 M) | 0.24 g |
| Hardening compound: K-1 $CH_2=CHSO_2CH_2CONH(CH_2)_3NHCOCH_2SO_2=CH=CH_2$ | 1.20 g |
| Water | 65 g |

The dispersion composition thus obtained was applied to the support (Bekk smoothness on the undercoating layer side: 500 sec/10 cc) of Type ELP-I master (produced by Fuji Photo Film Co., Ltd.) used as an electrophotographic lithographic printing plate precursor for simple printing by means of a wire bar, and then dried at a temperature of 100° C. for 10 minutes to form an image-receiving layer having a coated amount of 8 g/m$^2$. Thus, a lithographic printing plate precursor was obtained.

COMPARATIVE EXAMPLE A

A lithographic printing plate precursor was prepared in the same manner as in Example 1 except that as the image-receiving layer composition there was used only 33.9 g of Silysha 430 instead of Silysha 430 and Snowtex C.

COMPARATIVE EXAMPLE B

A lithographic printing plate precursor was prepared in the same manner as in Example 1 except that as the image-receiving layer composition there was used only 33.9 g (solid content) of Snowtex C instead of Silysha 430 and Snowtex C.

COMPARATIVE EXAMPLE C

A lithographic printing plate precursor was prepared in the same manner as in Example 1 except that the image-receiving layer was prepared by preparing a dispersion from the following compositions, and then applying the dispersion to a support and drying the coated material in the same manner as in Example 1. The drying of the coated material was effected at a temperature of 130° C. for 10 minutes.

| | |
|---|---|
| Polyvinyl alcohol: 10% aqueous solution of PVA-117 (produced by Kuraray Co., Ltd.) | 94 g |
| Silica: Silysha 430 | 21.9 g |
| 20% Solution of colloidal silica: Snowtex C | 90 g |
| 80% Aqueous solution of melamine formaldehyde resin | 1.2 g |
| 10% Aqueous solution of ammonium chloride | 1.1 g |
| Water | 55 g |

COMPARATIVE EXAMPLE D

A lithographic printing plate precursor was prepared in the same manner as in Example 1 except that the image-receiving layer was prepared by preparing a dispersion from the following compositions, and then applying the dispersion to a support and drying the coated material in the same manner as in Example 1. The drying of the coated material was effected at a temperature of 130° C. for 10 minutes.

| | |
|---|---|
| Polyvinyl alcohol: 10% aqueous solution of PVA-117 (produced by Kuraray Co., Ltd.) | 90 g |
| Silica: Syloid 308 (produced by Fuji Devison Chemical Co., Ltd.; grain diameter: 7 $\mu$m) | 30 g |
| 20% Solution of colloidal silica: Snowtex C | 150 g |
| 50% Aqueous dispersion of kaolin clay | 30 g |
| 80% Aqueous solution of melamine formaldehyde | 1.2 g |
| 10% Aqueous solution of ammonium chloride | 1.0 g |
| Water | 38 g |

These direct imaging lithographic printing plate precursors were then examined for film-forming properties (surface smoothness), surface wettability (contact angle with respect to water), film strength and plate-making properties.

These printing plates thus prepared were then examined for printability (background stain, impression capacity, etc.) as offset printing plate.

The results are set forth in Table 1.

TABLE 1

Results of the First Process

| | Example 1 | Comparative Example A | Comparative Example B | Comparative Example C | Comparative Example D |
|---|---|---|---|---|---|
| Smoothness of Surface Layer (sec/10 cc)[1] | 230 | 160 | 700 | 210 | 220 |
| Wettability of surface layer (degree)[2] | Not more than 5° | Not more than 5° | Not more than 5° | Not more than 5° | Not more than 5° |
| % Strength of surface layer[3] | 95 | 60 | 30 | 75 | 95 |
| Plate image quality[4] | Good; Fine lines and fine letters are good | Poor or fair; Slight blank in fine lines and fine letters, | Good; Fine lines and fine letters are good | Good; Fine lines and fine letters are good | Good; Fine lines and fine letters are good |

TABLE 1-continued

Results of the First Process

| | Example 1 | Comparative Example A | Comparative Example B | Comparative Example C | Comparative Example D |
|---|---|---|---|---|---|
| | | uneven solid area | | | |
| Printability[5] Image Quality | Good; Fine lines and fine letters are good | Poor; Blanks in fine lines and fine letters, uneven solid area | Good; Fine lines and fine letters are good | Good; Fine lines and fine letters are good | Good; Fine lines and fine letters are good |
| Background Stain on Non-Image Area | Good; No stain | Poor or fair; Slight background stain with printing ink | Poor or fair; Some background stain with printing ink | Very poor; Significant background stain with printing ink | Poor; Some background stain with printing ink |
| Impression Capacity[6] | 800 sheets | Blanks occur in image area from the beginning of printing | Background stain occurs from the beginning of printing Image-receiving layer breaks at about 100th sheet from the beginning of printing | Significant background stain occurs from the beginning of printing Blanks occur in image area at about 300th sheet from the beginning of printing | Blanks occur in image area at about 250th sheet from the beginning of printing |

TABLE 2

Results of the Second Process

| | Example 1 | Comparative Example A | Comparative Example B | Comparative Example C | Comparative Example D |
|---|---|---|---|---|---|
| Smoothness of Surface layer (sec/10 cc)[1] | 230 | 160 | 700 | 210 | 220 |
| Wettability of surface layer (degree)[2] | Not more than 5° | Not more than 5° | Not more than 5° | Not more than 5° | Not more than 5° |
| % Strength of Surface Layer[3] | 95 | 60 | 30 | 75 | 95 |
| Plate Image Quality[4] | Good; Fine lines and fine letters are good | Poor or fair; Slight blank in fine lines and fine letters, uneven solid area | Good; Fine lines and fine letters are good | Good; Fine lines and fine letters are good | Good; Fine lines and fine letters are good |
| Printability[5] Image Quality | Good; Fine lines and fine letters are good | Poor; Blanks in fine lines and fine letters, uneven solid area | Good; Fine lines and fine letters are good | Good; Fine lines and fine letters are good | Good; Fine lines and fine letters are good |
| Background Stain on Non-Image Area | Good; No stain | Poor or fair; Slight background stain with printing ink | Poor or fair; Some background stain with printing ink | Very poor; Significant background stain with printing ink | Poor; Some background stain with printing ink |
| Impression Capacity[6] | 1,000 sheets | Blanks occur in image area from the beginning of | Background stain occurs from the beginning of | Significant background stain occurs from the | Blanks occur in image area at about 250th sheet |

TABLE 2-continued

| Results of the Second Process | | | | |
|---|---|---|---|---|
| Example 1 | Comparative Example A | Comparative Example B | Comparative Example C | Comparative Example D |
| | printing | printing Image-receiving layer breaks at about 100th sheet from the beginning of printing | beginning of printing Blanks occur in image area at about 300th sheet from the beginning of printing | from the beginning of printing |

The properties set forth in Tables 1 and 2 were determined as follows.

1) Smoothness of Image-Receiving Layer

The lithographic printing plate precursor was measured for smoothness (sec/10 cc) at an air volume of 10 cc using a Bekk smoothness tester (produced by Kumagaya Riko K.K.).

2) Surface Wettability

2 $\mu$l of distilled water was put on the surface of the lithographic printing plate precursor. After 30 seconds, the surface contact angle (degree) was measured using a Type CA-D contact angle meter (produced by Kyowa Interface Science Corporation Limited). The smaller this value is, the better is wettability by water and the higher is hydrophilicity.

3) Mechanical Strength of Surface Layer

The surface of the lithographic printing plate precursor was repeatedly rubbed with an emery paper (#1000) under a load of 50 g/cm$^2$ using a Type Haydon-14 surface property testing material (produced by Shinsoku Kagaku K.K.). The powder produced by abrasion was then removed. The percent layer residue (%) was then calculated from the weight loss of the surface layer to determine the mechanical strength of the surface layer.

4) Plate Image Ouality

Using Phaser 340JS printer (produced by Sony-Tektronix Co., Ltd.), which is commercially available as a solid jet printer, and a black solid ink (Insteck Black: accessory of the printer), each lithographic printing plate precursor was subjected to plate-making according to the first or second process of the present invention. In the first process, the printer was modified such that an image can be drawn on a master directly.

The foregoing printer is structured as shown in FIG. 2*a* or 2*b* and FIGS. 3 to 4*b*. The foregoing black solid ink comprised a wax having a melting point of about 100° C. The ink obtained by melting the black solid ink at a temperature of 120° C. exhibited a viscosity of about 20 cps.

In the second process, the material of the intermediate transfer drum is anodized aluminum and exhibits a Bekk smoothness of not less than 3,000 sec/10 cc. The temperature of the intermediate transfer zone was 50° C.

The quality of duplicated image on the printing plate precursor thus obtained was visually evaluated through a 20× magnifier.

5) Print Image Ouality

A lithographic printing plate precursor was prepared in the same manner as in the above item 4). Using a Type AM-2850 full automatic printer (produced by AM Co.), printing was effected. In some detail, as a fountain solution there was used a solution obtained by diluting a PS plate processing agent (EV-3, produced by Fuji Photo Film Co., Ltd.) with distilled water 50 times. The fountain solution was put in a fountain solution receiving pan. An offset printing black ink was used. The printing plate precursor was passed through the printer. The printed matter at the 10th sheet was then visually evaluated for image quality (background stain, solid uniformity on image area, etc.) through a 20× magnifier.

6) Impression Capacity

Printing was effected in the same manner as in the above item 5). The number of printed sheets required until background stain or image blanks can be visually observed for the first time was determined.

As shown in Table 1, the image-receiving layer formed on the printing plate precursors of Example 1 and Comparative Examples C and D, which comprise the same support, exhibited almost the same smoothness. Comparative Example A, which comprises a finely divided synthetic silica powder alone, exhibited a slightly low smoothness. Comparative Example B, which comprises colloidal silica alone as a pigment, provided a highly smooth printing plate precursor.

The wettability of the surface layer was measured as contact angle with respect to water. As a result, all the printing plate precursors exhibited a low contact angle and hence a high hydrophilicity.

The surface layer was also measured for strength. As a result, Example 1 and Comparative Example D exhibited a high strength. On the other hand, Comparative Example C, which comprises PVA as a binder and a crosslinking agent (waterproofing) suitable for the binder, exhibited a drastically reduced strength as compared with Example 1. Further, Comparative Example A, which comprises a synthetic silica powder alone as an inorganic pigment, exhibited a drastically reduced strength. Comparative Example B, which comprises colloidal silica alone as an inorganic pigment, exhibited a further deterioration of strength.

These printing plate precursors were actually prepared. The plate image quality was then visually observed. The printing plate precursors of Comparative B, C and D, which are according to the present invention, were excellent both in plate image quality and print image quality. That is, the printing plates of the present invention obtained by jetting an ink from a printer to form an image had no blanks in fine lines and fine letters, no unevenness in solid area and no ink stain on non-image area.

On the other hand, Comparative Example A showed blanks in fine lines and fine letters and unevenness (white mark) on solid area.

These printing plates were then evaluated for printability by image quality of printed matters obtained therefrom. As a result, only the printing plates of the present invention gave an image free of blanks in fine lines and fine letters and unevenness on solid area and provided good printed matters free of ink stain on non-image area in an amount of 800 or more sheets in the first process and 1,000 or more sheets in the second process.

On the other hand, Comparative Example A showed remarkable blanks in fine lines and fine letters on image area and white marks on solid area in the printed image from the beginning of printing.

Comparative Examples B, C and D gave printed matters free of image defects as in Example 1. However, all these printing plates gave printed matters having an practically unacceptable printing ink stain on non-image area. Comparative Example B showed break in the image-receiving layer itself at about 100th sheet from the beginning of printing. Comparative Examples C and D showed blanks in image area at about 300th sheet and about 200th sheet, respectively, from the beginning of printing.

These results show that there is a close relationship between the physical properties of the image-receiving layer and the image properties on the printing plate and the printed matters depending on the kind of the inorganic pigment, hydrophilic resin and waterproofing agent to be combined with the particulate synthetic silica having a grain diameter of from 1 to 6 $\mu$m. Namely, the image-receiving layer comprising a particulate synthetic silica or ultrafinely particulate colloidal silica alone incorporated therein as an inorganic particulate material exhibits an insufficient strength and almost the same contact angle with respect to water as the product of the present invention. However, the resulting printed matters often show printing ink stain, and the image-receiving layer exhibits an insufficient hydrophilicity. Further, if as the binder resin there is used a known PVA, the resulting image-receiving layer exhibits a weak strength, and its hydrophilicity is not high enough to eliminate the problem of ink stain on the printed matters.

The image-receiving layer comprising PVA and clay as a pigment in combination as implemented in JP-B-5-17871 exhibits the same strength and plate image quality as the present invention but shows an insufficient hydrophilicity during printing.

In Comparative Examples C and D, even the image which had been thoroughly fixed by the printer exhibited an insufficient adhesion to the image-receiving layer. As a result, blanks occurred in image area at about 200th to 300th sheet from the beginning of printing.

These results show that only the printing plate precursor of the present invention can provide many sheets of good printed matters.

EXAMPLES 2 TO 3 AND COMPARATIVE EXAMPLE E

Preparation of Water-Resistant Support

As a substrate there was used a high quality paper having a basis weight of 100 g/m$^2$. A back layer coating compound having the following composition was then applied to one side of the substrate by means of a wire bar to form a back layer having a dry coated amount of 12 g/m$^2$. The substrate was then calendered such that it exhibited a smoothness of about 50 sec/10 cc on the back layer side thereof.

Back Coat Layer Coating Compound

| | |
|---|---|
| 50% Aqueous dispersion of kaolin | 200 parts by weight |
| 10% Aqueous solution of polyvinyl alcohol | 60 parts by weight |
| SBR latex (solid content: 50%; Tg: 0° C.) | 100 parts by weight |
| Melamine resin (Sumirez Resin SR-613; solid content: 80%) | 5 parts by weight |

An undercoating layer coating compound having the following composition was then applied to the other side of the substrate by means of a wire bar to form an undercoating layer having a dry coated amount of 10 g/m$^2$. The substrate was then calendered such that it exhibited a smoothness set forth in Tables 3 and 4 on the undercoating layer side thereof.

Undercoating Laver Coating Compound

| | |
|---|---|
| 50% Aqueous dispersion of clay | 60 g |
| SBR latex (solid content: 50%; Tg: 25° C.) | 36 g |
| Melamine resin (Sumirez resin SR-613; solid content: 80%) | 4 g |
| Water | 105 g |

Thus, three kinds of water-resistant supports were prepared as Support Sample Nos. 01 to 03, respectively, as set forth in Tables 3 and 4.

TABLE 3

| Smoothness of Undercoating Layer (sec/10 cc) | Support Sample No. |
|---|---|
| 150 | 01 |
| 700 | 02 |
| 1,500 | 03 |

Preparation of Lithographic PrintinQ Plate Precursor

Subsequently, a dispersion having the following composition was applied to Support Sample Nos. 01 to 03 in a dry coated amount of 6 g/m$^2$ each to form an image-receiving layer thereon. Thus, lithographic printing plate precursors were prepared as set forth in Tables 4 and 5. These printing plate precursors each exhibited a surface smoothness of from 200 to 230 sec/10 cc, a contact angle of not more than 5° with respect to water and a surface layer film strength of from 96 to 97%.

Image-receiving Layer Coating Compound

The following compositions were subjected to dispersion with glass beads in a paint shaker (produced by Toyo Seiki Seisakusho, Ltd.) for 60 minutes. The glass beads were then removed by filtration to obtain a dispersion.

| | |
|---|---|
| 10% Aqueous solution of gelatin | 100 g |
| Silica: Silysha 310 (produced by Fuji-Silysha Chemical Ltd.; average grain diameter: 1.4 $\mu$m) | 22 g |
| Aluminasol 520 (produced by Nissan Chemical Industries, Ltd.; average grain diameter: 10 to 20 nm) | 90 g |
| Fluorinated alkylester FC430 | 0.3 g |
| Hardening compound: K-2 $CH_{2=CHSO2}(CH_2)_2O(CH_2)_2O(CH_2)_2SO_2CH{=}CH_2$ | 1.5 g |
| Water | 70 g |

The various lithographic printing plate precursors thus prepared were then processed in the same manner as in Example 1 to prepare printing plates according to the first and second process of the present invention. Using a Type Oliver 94 printer (produced by Sakurai Seisakusho K.K.), printing was effected as follows. As a fountain solution, a solution obtained by diluting SLM-0D (produced by Mitsubishi Paper Mills, Limited.) with distilled water 100 times was put in a fountain solution receiving pan. An offset printing black ink was used.

The quality of drawn image on the printing plates were evaluated as follows. The results are set forth in Tables 4 and 5.

TABLE 4

| | Results of First Process | | | |
|---|---|---|---|---|
| | Support Sample No. | Plate image quality[7)] | Print image quality[8)] | Number of printable sheets[9)] |
| Example 2 | 02 | Good | Good | Not less than 800 |
| Example 3 | 03 | Excellent | Excellent | Not less than 800 |
| Comparative Example E | 01 | Poor | Poor | Troubles occur from the beginning of printing |

TABLE 5

| | Results of Second Process | | | |
|---|---|---|---|---|
| | Support Sample No. | Plate image quality[7)] | Print image quality[8)] | Number of printable sheets[9)] |
| Example 2 | 02 | Good | Good | Not less than 1,000 |
| Example 3 | 03 | Excellent | Excellent | Not less than 1,000 |
| Comparative Example E | 01 | Poor | Poor | Troubles occur from the beginning of printing |

The properties set forth in Tables 4 and 5 were determined as follows.

7) Plate Image Ouality

The drawn image on the printing plate was observed under an optical microscope at a magnification of 20×.

Excellent: No defects in drawn image, very good fine lines and fine letters

Good: No defects in drawn image, good fine line and fine letters

Poor: Blanks and defects in fine lines and fine letters

8) Print Image Ouality

The image quality of the printed matters was evaluated in the same manner as in the foregoing plate image quality.

9) Impression Capacity

The number of sheets required until background stain or image blanks on the printed matters can be visually recognized for the first time was determined.

As shown in Tables 5 and 6, the printing plate precursor having almost the same surface smoothness on the image-receiving layer as the present invention but having a support smoothness as low as 150 sec/10 cc exhibits a deteriorated plate image quality and shows image defects from the beginning of printing. On the other hand, the printing plate precursor of the present invention shows improvements as its surface smoothness increases. It shows an impression capacity of not less than 800 sheets in the first process and not less than 1,000 sheets in the second process.

This is probably because the smoothness of the support directly under the image-receiving layer has a great effect on the smoothness of the surface of the image-receiving layer. The flatness is drastically lost on the point where the image-receiving layer is on the uneven surface of the support. At this point, image defects occur.

In other words, the high the smoothness of the undercoating layer on the support directly under the image-receiving layer is, the better are the plate image quality and print image quality.

EXAMPLES 4 AND 5 AND COMPARATIVE EXAMPLES F AND G

Preparation of Water-Resistant Support

An aqueous latex of ethylene-methyl acrylate-acrylic acid copolymer (molar ratio: 65:30:5) was applied to both sides of a high quality paper having a basis weight of 95 g/m$^2$ in a dry coated amount of 0.2 g/m$^2$, and then dried. A pellet obtained by melt-kneading 70% of a low density polyethylene having a density of 0.920 g/cc and a melt index of 5.0 g/10 min, 1.5% of a high density polyethylene having a density of 0.950 g/cc and a melt index of 8.0 g/10 cc and 15% of an electrically-conductive carbon was then extruded onto one side of the substrate so that it was laminated thereon to a thickness of 25 $\mu$m. Thus, a uniform polyethylene layer (surface resistivity: $6\times10^9$ Ω) was formed. Subsequently, the substrate was calendered to adjust its smoothness to 2,000 sec/10 cc.

A backcoat layer coating compound having the following composition was then applied to the other side of the substrate in a dry coated amount of 20 g/m$^2$ to form a backcoat layer (surface resistivity: $8\times10^7$ Ω) thereon. The substrate was then calendered under conditions such that it exhibits a smoothness of 450 sec/10 cc on the backcoat layer side thereof.

Backcoat Layer Coating Compound

| | |
|---|---|
| 50% Aqueous dispersion of clay | 200 parts by weight |
| 20% Aqueous solution of oxidized starch | 40 parts by weight |
| SBR latex (solid content: 49%; Tg: 10° C.) | 150 parts by weight |
| Precondensate of melamine resin (Sumirez Resin SR-613; solid content: 80%) | 10 parts by weight |

Subsequently, the surface of the polyethylene layer was subjected to corona discharge treatment at 5 KVA·sec/m$^2$. An image-receiving layer was then provided on the polyethylene layer in the following manner to prepare a lithographic printing plate precursor.

Preparation of Lithographic Printing Plate Precursor

The following compositions were subjected to dispersion with glass beads in a paint shaker (produced by Toyo Seiki Seisakusho, Ltd.). The dispersion time was adjusted such that the resulting surface layer exhibited a smoothness as set forth in Tables 6 and 7. The glass beads were then removed by filtration to obtain a dispersion.

| | |
|---|---|
| 10% Aqueous solution of gelatin | 100 g |
| Silica: Silysha 310 | 25 g |
| Colloidal silica: Snowtex C | 100 g |
| Sodium dodecylbenzenesulfonate | 2.0 g |
| Hardening compound: K-3 $CH_2{=}CH{-}CONH(CH_2)_2N(CH_2)_2NHCOCH{=}CH_2$ | 2.2 g |
| Water | 65 g |

The foregoing dispersion composition was applied to the foregoing water-resistant support by means of a wire bar, and then dried at a temperature of 110° C. for 20 minutes to form an image-receiving layer having a coated amount of 6 g/m$^2$ thereon. Thus, various lithographic printing plate precursors were prepared as shown in Tables 6 and 7.

TABLE 6

Results of First Process

| | Example 4 | Example 5 | Comparative Example F | Comparative Example G |
|---|---|---|---|---|
| Surface smoothness (sec/10 cc) | 50 | 180 | 15 | 600 |
| % Strength on the back layer | 96 | 97 | 90 | 98 |
| Plate image quality | Good | Excellent | Poor | Excellent |
| Print image quality | Good | Excellent | Poor | Excellent |
| Impression capacity | 800 sheets | 800 sheets | Background stain occurs from the beginning of printing | 400 sheets |

TABLE 7

Results of Second Process

| | Example 4 | Example 5 | Comparative Example F | Comparative Example G |
|---|---|---|---|---|
| Surface smoothness (sec/10 cc) | 50 | 180 | 20 | 600 |
| % Strength on the back layer | 96 | 97 | 90 | 98 |
| Plate image quality | Good | Excellent | Poor | Excellent |
| Print image quality | Good | Excellent | Poor | Excellent |
| Impression capacity | 1,000 sheets | 1,000 sheets | Background stain occurs from the beginning of printing | 500 sheets |

As shown in Tables 6 and 7, with respect to the image-receiving layers having the same composition but different smoothness and being provided on a water-resistant support having the same high smoothness undercoating layer, Comparative Example F, which exhibits a Bekk smoothness of 15 sec/10 cc, showed a remarkably poor plate image quality, while the other examples exhibited a better image quality with an increase of the smoothness.

The printed matters of Comparative Example G, which exhibits a smoothness as high as 600 sec/10 cc, showed blanks in image area at about 400th sheet from the beginning of printing in the first process and at about 500th sheet from the beginning of printing in the second process.

Thus, good plate image quality, print image quality and impression capacity can be obtained when the surface smoothness of the image-receiving layer falls within the predetermined range.

EXAMPLES 6 TO 12

Lithographic printing plate precursors were prepared in the same manner as in Example 4 except that compounds set forth in Table 8 were used instead of the gelatin-curing compound (K-3), respectively. The surface of the various printing plate precursors thus obtained exhibited a Bekk smoothness of from 50 to 180 sec/10 cc. All these printing plate precursors exhibited a contact angle of not more than 5° with respect to water.

TABLE 8

| Example No. | Curing compound | | % Strength of image-receiving layer |
|---|---|---|---|
| 6 | (K-4) $CH_2{=}CH{-}SO_2NH(CH_2)_3NHSO_2CH{=}CH_2$ | 1.2 g | 95% |
| 7 | (K-5) 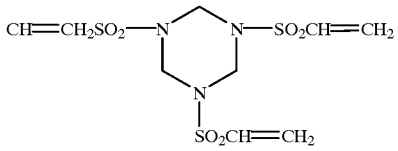 | 0.3 g | 98% |
| 8 | (K-6) 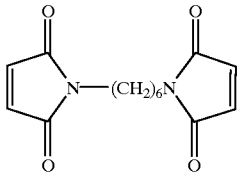 | 1.0 g | 95% |
| 9 | (K-7) $[Cl(CH_2)_2SO_2CH_2O]_2C{=}O$ | 1.3 g | 96% |
| 10 | (K-8) 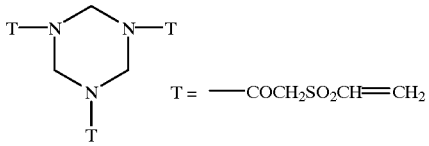 | 0.3 g | 98% |

As shown in Table 8, the image-receiving layer of the printing plate precursors exhibited a strength as nt as not less than 95%.

These printing plate precursors were processed to form plates which were then desensitized in the same manner ample 1. These printing plates were then used in offset printing.

The resulting printed matters showed a sharp image free of stain on non-image area as in Example 1. These excellent printed matters were obtained in an amount of not less than 800 sheets in the first process and not less than 1,000 sheets in the second process. This shows that these examples give excellent print image quality and impression capacity.

EXAMPLE 13

A lithographic printing plate precursor was prepared in the same manner as in Example 4 except that 15 g (solid content) of a 5% aqueous solution of titanium oxide sol was used instead of 20 g (solid content) of colloidal silica (Snowtex C).

The surface layer of the lithographic printing plate precursor thus prepared exhibited a Bekk smoothness of 210 sec/10 cc, a contact angle of not more than 5° with respect to water and a film strength of 95%.

The lithographic printing plate precursor each was processed in the same manner as in Example 1 to form a printing plate which was then used in offset printing.

The resulting printed matters showed a sharp image free of stain on non-image area as in Example 1. These excellent printed matters were obtained in an amount of not less than 800 sheets in the first process and not less than 1,000 sheets in the second process.

While the invention has been described in detail and with reference to specific embodiments thereof, it will be apparent to one skilled in the art that various changes and modifications can be made therein without departing from the spirit and scope thereof.

What is claimed is:

1. A process for producing a lithographic printing plate by forming an image by means of a hot melt type ink jet process, which comprises:

preparing a direct imaging lithographic printing plate precursor comprising a water-resistant support having provided thereon an image-receiving layer containing an inorganic pigment and a hydrophilic binder resin as main components;

heat-melting an ink composition being solid at a temperature of not less than 35° C.;

and then jetting droplets of the molten ink composition onto the image-receiving layer through a nozzle to form an image thereon, wherein the image-receiving layer comprises:

as the inorganic pigment, a particulate silica having an average grain diameter of from 1 to 6 $\mu$m and an ultrafinely particulate colloidal inorganic pigment having an average grain diameter of from 10 to 50 nm are used in a weight ratio of 40:60 to 70:30; and as the hydrophilic binder resin, gelatin in such an amount that a weight ratio of the inorganic pigment to gelatin is from 85:15 to 40:60, the image-receiving layer being cured with a gelatin-curing compound to exhibit water resistance.

2. The process of claim 1, wherein the image-receiving layer of the lithographic printing plate precursor has a surface which receives an image, wherein said surface exhibits a Bekk smoothness of from 30 to 500 second/10 cc.

3. The process of claim 1, wherein a surface of the support to be adjacent to the image-receiving layer exhibits a Bekk smoothness of not less than 300 second/10 cc.

4. The process of claim 1, wherein the ultrafinely particulate colloidal inorganic pigment is colloidal silica, alumina sol or ultrafinely particulate titanium oxide.

5. The process of claim 1, wherein the gelatin-curing compound is a compound containing per molecule two or more of double bond represented by formula (I):

$CH_2{=}CH{-}X{-}$ (I)

wherein X represents $-OSO_2-$, $-SO_2-$, $-CONR-$ or $-SO_2NR-$, in which R represents a hydrogen atom or an aliphatic group having 1 to 8 carbon atoms.

6. The process of claim 1, wherein the ink composition comprises a wax having a melting point of from 50° C. to 150° C., a coloring material and an adhesion improver and, when heated to a temperature of 80° C. to 150° C., is capable of becoming a hot-melted solution having a viscosity of from 1 to 20 cps.

7. A process for producing a lithographic printing plate by forming an image by means of a hot melt type ink jet process, which comprises:

preparing a direct imaging lithographic printing plate precursor comprising a water-resistant support having provided thereon an image-receiving layer containing an inorganic pigment and a hydrophilic binder resin as main components;

heat-melting an ink composition being solid at a temperature of not less than 35° C.;

jetting droplets of the molten ink composition onto an intermediate transfer unit through a nozzle to form an image thereon;

and then contact-transferring the image onto the image-receiving layer of the direct imaging lithographic printing plate precursor, wherein the image-receiving layer comprises:

as the inorganic pigment, a particulate silica having an average grain diameter of from 1 to 6 $\mu$m and an ultrafinely particulate colloidal inorganic pigment having an average grain diameter of from 10 to 50 nm are used in a weight ratio of 40:60 to 70:30; and as the hydrophilic binder resin, gelatin in such an amount that a weight ratio of the inorganic pigment to gelatin is from 85:15 to 40:60, the image-receiving layer being cured with a gelatin-curing compound to exhibit water resistance.

8. The process of claim 7, wherein the image-receiving layer of the lithographic printing plate precursor exhibits a Bekk smoothness of from 30 to 500 second/10 cc.

9. The process of claim 7, wherein a surface of the support on which the image-receiving layer is provided exhibits a Bekk smoothness of not less than 300 second/10 cc.

10. The process of claim 7, wherein the ultrafinely particulate colloidal inorganic pigment is colloidal silica, alumina sol or ultrafinely particulate titanium oxide.

11. The process of claim 7, wherein the gelatin-curing compound is a compound containing per molecule two or more of double bond represented by formula (I):

$CH_2{=}CH{-}X{-}$ (I)

wherein X represents $-OSO_2-$, $-SO_2-$, $-CONR-$ or $-SO_2NR-$, in which R represents a hydrogen atom or an aliphatic group having 1 to 8 carbon atoms.

12. The process of claim 7, wherein the ink composition comprises a wax having a melting point of from 50° C. to 150° C., a coloring material and an adhesion improver and, when heated to a temperature of 80° C. to 150° C., is capable of becoming a hot-melted solution having a viscosity of from 1 to 20 cps.

* * * * *